US006779585B2

(12) United States Patent
Zumberger et al.

(10) Patent No.: US 6,779,585 B2
(45) Date of Patent: Aug. 24, 2004

(54) METHOD FOR CONTROLLING LADLE MOTION TO REDUCE ALUMINUM OXIDE FORMATION

(75) Inventors: Mark Zumberger, DeGraff, OH (US); Steve Pape, New Bremen, OH (US); John David Pinkerton, Jr., Bellefontaine, OH (US); Josh Edwards, Bellefontaine, OH (US); Keith Bergman, Minster, OH (US); Yukio Kawai, Sidney, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 128 days.

(21) Appl. No.: 10/254,195

(22) Filed: Sep. 25, 2002

(65) Prior Publication Data

US 2004/0055731 A1 Mar. 25, 2004

(51) Int. Cl.[7] ..... B22D 39/00

(52) U.S. Cl. ..... 164/136; 164/336; 222/590; 222/629

(58) Field of Search ..... 164/136, 336; 222/590, 629

(56) References Cited

U.S. PATENT DOCUMENTS

| | | | | |
|---|---|---|---|---|
| 1,257,214 A | | 2/1918 | Graham | |
| 2,463,811 A | | 3/1949 | Schulze | |
| 2,892,225 A | | 6/1959 | Buhrer et al. | |
| 3,514,018 A | | 5/1970 | Petig et al. | |
| 3,739,954 A | | 6/1973 | Blagg | |
| 3,923,201 A | | 12/1975 | Hersh et al. | |
| 4,022,359 A | * | 5/1977 | Smidt | 222/629 |
| 4,025,060 A | | 5/1977 | Fujie et al. | |
| 4,074,837 A | | 2/1978 | Engel | |
| 4,078,707 A | | 3/1978 | Ishikawa | |
| 4,168,739 A | | 9/1979 | Smith et al. | |
| 4,205,717 A | | 6/1980 | Smith | |
| 4,215,854 A | | 8/1980 | Lustenberger | |
| 4,289,259 A | | 9/1981 | O'Brien | |
| 4,324,392 A | | 4/1982 | White et al. | |
| 4,516,699 A | * | 5/1985 | Burton et al. | 222/591 |
| 5,011,120 A | | 4/1991 | Bear | |
| 5,131,452 A | | 7/1992 | Bilz et al. | |

* cited by examiner

*Primary Examiner*—T Alexandra Elve
*Assistant Examiner*—Len Tran
(74) *Attorney, Agent, or Firm*—Rankin, Hill, Porter & Clark LLP; Alan T. McDonald; Vincent Ciamacco

(57) ABSTRACT

A method for filling a ladle cup of a ladle assembly with molten aluminum to reduce formation of aluminum oxides. The ladle cup is rotated into alignment with an axis of a ladle arm, which carries the ladle cup, such that a plane defined by the ladle cup rim is generally parallel to the ladle arm axis and the opening of the ladle cup faces parallel to a surface of the molten aluminum. The ladle cup is inserted into the bath of molten aluminum while maintained in alignment with the ladle arm axis. When the ladle cup reaches its final position within the bath of molten aluminum, the ladle cup is rotated to a desired angular orientation, which corresponds to a desired shot weight, and then is raised out of the molten aluminum while being retained in the desired angular orientation.

12 Claims, 2 Drawing Sheets

METHOD FOR CONTROLLING LADLE MOTION TO REDUCE ALUMINUM OXIDE FORMATION

BACKGROUND OF THE INVENTION

1. Field of the Invention

The present invention is generally directed toward aluminum dipping ladies and, more particularly, toward a method of controlling dipping ladle cup motion to reduce formation of aluminum oxide.

2. Description of Related Art

In an aluminum die casting process, molten aluminum is mechanically delivered from a dipwell of the furnace to the shot sleeve of the die case machine by a ladle cup. The ladle cup is a portion of a ladling unit or assembly, which includes a mechanical ladle arm and a carriage to move the ladle cup between the dipwell and the shot sleeve.

With reference to FIGS. 1*a*–1*c*, a conventional ladle cup filling process is illustrated. In this prior art method, the ladle assembly 10 includes a ladle cup 12 and a mechanical ladle arm 14. The ladle cup 12 is generally bowl shaped and includes an open rim 16, a rear edge 18 pivotally secured to the ladle arm 14, and a front edge 20 opposite the rear edge 18. During the method, the ladle cup 12 is positioned vertically adjacent the surface 22 of the molten aluminum contained within the dipwell 24 (FIG. 1*a*). Thereafter, the ladle cup 12 is rotated (clockwise in FIG. 1*b*) to a desired angular orientation representing a predetermined shot weight, which is calculated by the die cast machine controller based upon a desired shot weight entered by the machine operator. This step is referred to in the art as the "shot weight angle adjust".

Thereafter, the ladle arm 14 and ladle cup 12 are lowered, while the ladle cup 12 is retained at the desired angular orientation. As the front edge 20 of the cup rim 16 drops beneath the surface 22 of the molten aluminum, the molten aluminum overflows into the ladle cup rim 16 and rushes into the ladle cup 12 with great turbulence, as indicated by the arrows in FIG. 1*c*. After filling of the ladle cup 12 is complete, the ladle cup is withdrawn from the dipwell 24, while maintained in the desired angular orientation, and is transported to the shot sleeve (not shown).

Unfortunately, aggressive filling of the ladle cup 12 according to the prior art method causes air to be mixed with the molten aluminum, both the molten aluminum in the ladle cup and, perhaps to a lesser extent, the molten aluminum outside of the ladle cup and remaining in the dipwell, and causes aluminum oxides to be formed. The aluminum oxides withdrawn by the ladle cup 12 will be cast with the molten aluminum in that pour or shot. The aluminum oxides remaining in the molten aluminum bath can be later picked up by the ladle cup 12 and cast in subsequent shots.

Aluminum oxide is a very hard material, especially when compared with aluminum. When cast into a part, aluminum oxides define localized hard spots that are detrimental to the tooling used in subsequent machining of the cast part. The aluminum oxides often damage or prematurely wear the tooling. Accordingly, formation of aluminum oxides and inclusion of aluminum oxides in cast parts results in machine downtime, tooling replacement costs, increased labor, and lower parts yield.

In response to this problem, aluminum die casters have attempted to slow the rate of insertion of the ladle cup, which is in the shot weight angle adjust position, into the bath of molten aluminum. Unfortunately, due to the manner in which molten aluminum overflows and tumbles as it enters the ladle cup, slowing the rate of insertion has had little effect in reducing the formation of aluminum oxides. Additional countermeasures, such as filtering of the molten aluminum, fluxing of the aluminum bath, and more frequent skimming and cleaning of the dipwell, have also been proposed. However, these additional countermeasures have proven ineffective in significantly reducing the introduction of aluminum oxides into the cast parts and, more importantly, have not significantly reduced the amount of parts sent to machining with aluminum oxide impurities.

SUMMARY OF THE INVENTION

The present invention is directed toward an improved method of filling a ladle cup with molten aluminum in which the formation of aluminum oxides is reduced or minimized.

In accordance with the present invention, the ladle cup is pivotally mounted to a ladle arm. The ladle cup and ladle arm are disposed over the bath of molten aluminum, and the ladle cup is rotated into alignment with an axis of the ladle arm. As such, a plane defined by the ladle cup rim is generally parallel to the ladle arm axis and the ladle cup opening faces generally parallel to a surface of the molten aluminum. The ladle cup is inserted into the bath of molten aluminum while maintained in alignment with the ladle arm axis, thereby allowing the molten aluminum to gently flow into and fill the ladle cup as the ladle cup is further lowered to its final position within the bath of molten aluminum. Thereafter, the ladle cup is rotated to a desired angular orientation, which corresponds to a desired shot weight or volume of molten aluminum within the ladle cup. While the ladle cup is retained in the desired angular orientation, the ladle cup is raised out of the molten aluminum.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 2A:
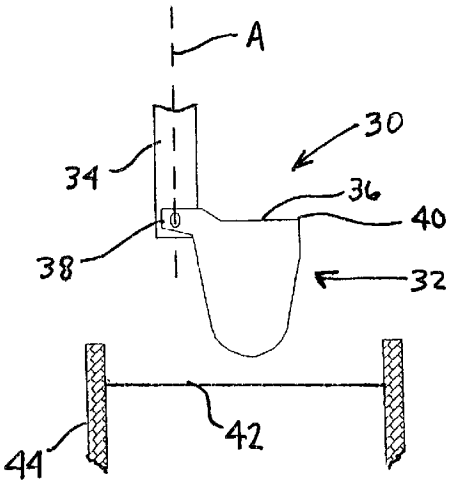

With reference to FIGS. 2*a*–2*d*, the ladle cup filling process according to the present invention is illustrated. First, with reference to FIG. 2*a,* the ladle assembly 30 includes a ladle cup 32 and ladle arm 34. The ladle cup 32 is bowl-shaped and includes an open upper rim 36. The rim 36 generally defines a plane P, and has a rear edge 38 and a front edge 40. The cup opening defined by the rim 36 generally faces in a direction perpendicular to the plane P. The rear edge 38 of the ladle cup 32 is pivotally secured to the ladle arm 34, and is pivotally driven by a motor, mechanical linkage, or the like (not shown). The ladle arm 34 is movable between the furnace dipwell 44 and a shot sleeve of a die casting machine (not shown). Motors or equivalent mechanical devices (not shown) are provided to move the ladle arm 34 between the dipwell and the die casting machine and to control the angular orientation of the ladle cup 32 relative to the ladle arm 34, which defines a longitudinal axis A. In FIG. 2*a,* the ladle assembly 30 is shown in a pre-filling stage disposed over a surface 42 of the molten aluminum contained within the dipwell 44.

The foregoing structure of the ladle assembly 30 is considered to be well known in the art. Moreover, the mechanical means used to translate the ladle arm and rotate the ladle cup are also well known to those skilled in the art, are not considered to be part of the present invention, and will not be further discussed hereinafter.

Figure 2B:
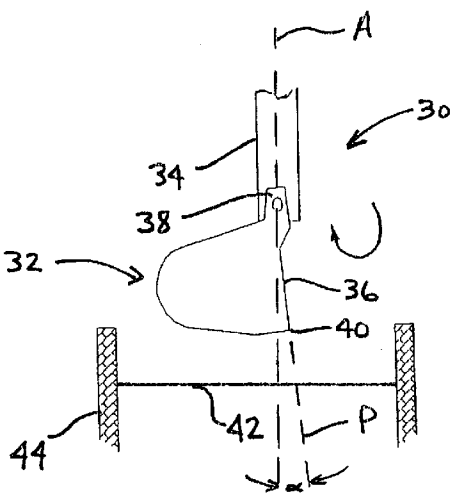

After the ladle cup 32 is moved into position over the furnace dipwell 44, the ladle cup 32 is rotated (clockwise in the drawing) so that the cup rim 36 is aligned with the longitudinal axis A of the ladle arm 34, as shown in FIG. 2*b*. In this context, "aligned" means that the plane P defined by the cup rim 36 is preferably at an angle $\alpha$ of ±10° to the ladle arm axis A and, more preferably, at an angle $\alpha$ of ±5° to the ladle arm axis and, most preferably, parallel to the ladle axis. In the illustrated embodiment, the angle $\alpha$ is shown to be about 5° for purposes of clarity. Also, insofar as the cup rim 36 may include a pouring spout and other surface profiles that prevent it from being thought of, in the strictest sense, as defining a "plane", the term "aligned" as used herein is further defined as the condition in which the ladle cup opening, which is surrounded by the cup rim 36, is facing in a direction that is generally parallel ($\pm\alpha$) to the surface 42 of the molten aluminum in the dipwell 44.

Figure 2C:
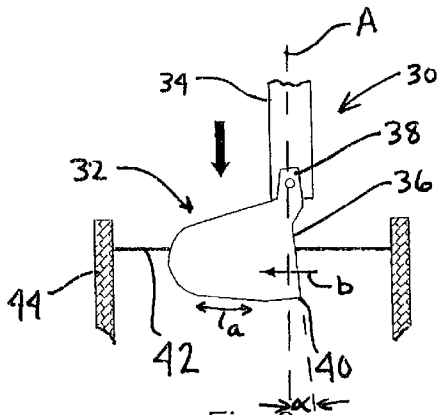

With the ladle cup 32 maintained in alignment with the ladle arm axis A, the ladle arm 34 is lowered to introduce the ladle cup 32 into the molten aluminum, as shown in FIG. 2*c*. As the ladle cup 32 penetrates the surface 42 of the molten aluminum and is further lowered into the dipwell 44, the molten aluminum is slowly displaced from beneath the ladle cup (arrows a) and aluminum gently flows into the ladle cup (arrows b). As will be appreciated, the height of aluminum in the dipwell 44 may rise slightly during the insertion of the ladle cup 32 into the molten aluminum.

By controlling the rate of insertion, rotation, and removal of the ladle cup, turbulence and air/aluminum mixing during filling of the ladle cup 32 can be greatly controlled to the point of being considered to be negligible. Therefore, it is important to slowly introduce the ladle cup 32 into the molten aluminum to minimize air/aluminum mixing, which could be created by the ladle cup 32 displacing molten aluminum as well as by molten aluminum flowing into the ladle cup 32.

Figure 2D:
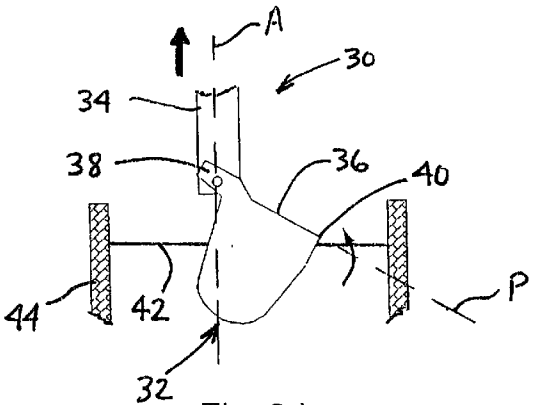

With reference to FIG. 2*d*, after reaching its final position within the dipwell and, thus, being filled with molten aluminum, the ladle cup 32 is rotated (counterclockwise in the drawing) to the desired angular orientation (shot weight angle adjust) corresponding to the predetermined shot weight or volume of aluminum retained in the ladle cup 32. As noted previously, the shot weight angle adjust is calculated by the die cast machine controller based upon a desired shot weight entered by the machine operator.

As further turbulence and air/aluminum mixing may occur during this step, the ladle cup 32 is slowly rotated from the aligned position (FIG. 2*c*) to the angled position (FIG. 2*d*) slowly so as to minimize formation of aluminum oxides. Naturally, the ladle cup 32 is rotated back to the desired angular orientation while still submerged in the molten aluminum, and then is slowly withdrawn from the dipwell 44 to the position shown in FIG. 2*d*. Again, the withdrawal or removal of the ladle cup 32 is performed at a speed wherein mixing and/or disturbance of the aluminum in the bath is minimized or prevented. Thereafter, the ladle cup, including the predetermined volume or shot of aluminum held thereby, is transported to the shot sleeve of the die cast machine.

Figure 1C:
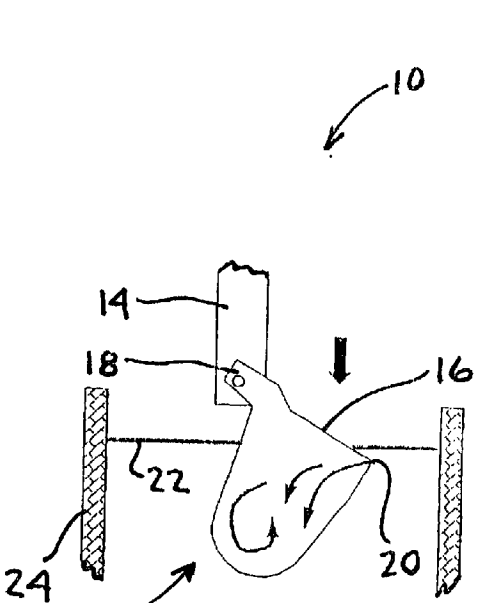
Fig. 1c Prior Art
FIGS. 1*a*–1*c* illustrate sequential method steps in a conventional ladle cup filling process; and, FIGS. 2*a*–2*d* illustrate sequential method steps in a ladle cup filling process according to the present invention.
Figure 1B:
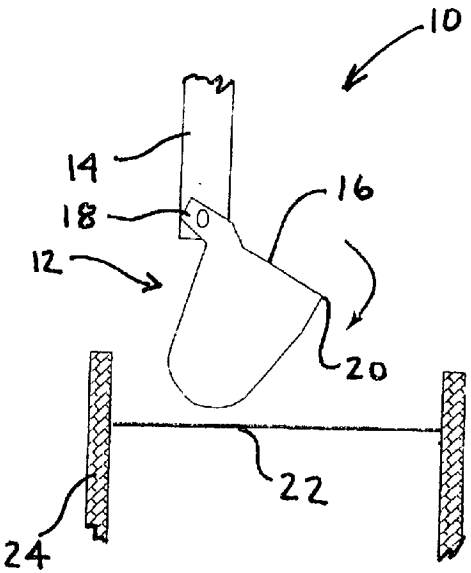
Fig. 1b Prior Art
Figure 1A:
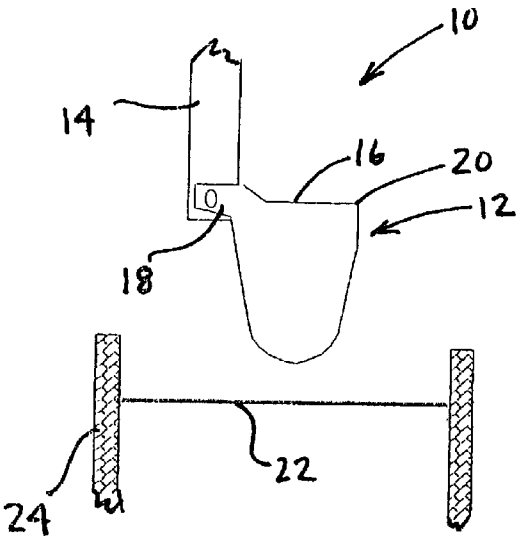
Fig. 1a Prior Art

Based upon studies conducted by the inventors, the foregoing ladle cup filling process has proven to be a substantial improvement in the art. In using the prior art method illustrated in FIGS. 1*a*–1*c* and described hereinbefore, damaged tooling resulting from contact with aluminum oxide hard spots in cast aluminum parts was experienced, on average, at a rate of about 3.9 incidents/month. Following adoption of the ladle cup filling method according to the present invention, the average number of incidents of damaged tooling dropped to 0.60 incidents/month. Since each incident of damaged tooling costs several thousand dollars in down time, tooling replacement costs, and lost parts, the present invention provides a substantial advantage over that known in the art.

While the preferred embodiment of the present invention has been disclosed herein, the present invention is not limited thereto. Rather, the method of the present invention is capable of numerous modification and improvements and, therefore, the scope of the present invention is only defied by the claims appended hereto.

What is claimed is:

1. A method for filling a ladle cup of a ladle assembly, said ladle assembly comprising a ladle arm and the ladle cup, said ladle arm defining an axis and said ladle cup defining an opening, the method comprising the steps of:

a) moving the ladle arm and ladle cup over a furnace dipwell containing a bath of molten metal, said ladle cup being disposed relative to the ladle arm such that said ladle cup opening is aligned with the ladle arm axis;

b) lowering the ladle arm and the ladle cup relative to the bath of molten metal so as to insert the ladle cup into the molten metal;

c) further lowering the ladle arm and the ladle cup until said ladle cup is filled with molten metal a desired amount;

d) rotating said ladle cup out of alignment with said ladle arm axis; and, e) raising said ladle arm and said ladle cup relative to the bath of molten metal so as to remove said ladle cup from said bath of molten metal.

2. The method according to claim 1, wherein, in step (d), the ladle cup is rotated to a predetermined angular orientation, said predetermined angular orientation corresponding to a desired shot weight.

3. The method according to claim 2, wherein, in step (e), the ladle cup is retained in the predetermined angular orientation while being raised out of the bath of molten metal.

4. The method according to claim 1, wherein step (a) includes the steps of:

moving said ladle cup and ladle arm over said dipwell; and, rotating said ladle cup in a first direction so as to align said ladle cup opening with said ladle arm axis.

5. The method according to claim 4, wherein, in step (d), the ladle cup is rotated in a second direction, opposite to said first direction.

6. The method according to claim 5, wherein, in step (d), the ladle cup is rotated to a predetermined angular orientation, said predetermined angular orientation corresponding to a desired shot weight.

7. The method according to claim 6, wherein, in step (e), the ladle cup is retained in the predetermined angular orientation while being raised out of the bath of molten metal.

8. The method according to claim 1, wherein said ladle cup is maintained in alignment with the ladle arm axis as the ladle cup is lowered in steps (b) and (c).

9. The method according to claim 8, wherein step (a) includes the steps of:

moving said ladle cup and ladle arm over said dipwell; and, rotating said ladle cup in a first direction so as to align said ladle cup opening with said ladle arm axis.

10. The method according to claim 9, wherein, in step (d), the ladle cup is rotated in a second direction, opposite to said first direction.

11. The method according to claim 10, wherein, in step (d), the ladle cup is rotated to a predetermined angular orientation, said predetermined angular orientation corresponding to a desired shot weight.

12. The method according to claim 11, wherein, in step (e), the ladle cup is retained in the predetermined angular orientation while being raised out of the bath of molten metal.

* * * * *